US005849451A

United States Patent [19]

Ishihara et al.

[11] Patent Number: 5,849,451

[45] Date of Patent: Dec. 15, 1998

[54] ELECTROPHOTOGRAPHIC DRY TONER COMPRISING INORGANIC PARTICLES

[75] Inventors: Yuka Ishihara; Chiaki Suzuki; Tetsu Torigoe; Atuhiko Eguchi; Takayoshi Aoki, all of Minami-ashigara, Japan

[73] Assignee: Fuji Xerox Co., Ltd., Tokyo, Japan

[21] Appl. No.: 895,634

[22] Filed: Jul. 17, 1997

Related U.S. Application Data

[63] Continuation of Ser. No. 498,498, Jul. 15, 1995, abandoned, which is a continuation of Ser. No. 119,591, Sep. 13, 1993, abandoned.

[30] Foreign Application Priority Data

Sep. 16, 1992 [JP] Japan ..... 4-270732

[51] Int. Cl.[6] ..... G03G 9/00

[52] U.S. Cl. ..... 430/110; 430/111; 430/903

[58] Field of Search ..... 430/110, 111, 430/903

[56] References Cited

U.S. PATENT DOCUMENTS

| | | | |
|---|---|---|---|
| 4,265,995 | 5/1981 | Mammino | 430/110 |
| 4,303,749 | 12/1981 | Gruber et al. . | |
| 4,752,550 | 6/1988 | Barbetta et al. | 430/110 |
| 5,137,796 | 8/1992 | Takiguchi et al. | 430/106.6 |
| 5,378,572 | 1/1995 | Akiyama et al. | 430/110 |

FOREIGN PATENT DOCUMENTS

| | | |
|---|---|---|
| 0467439 | 1/1992 | European Pat. Off. . |
| 46-5782 | 12/1971 | Japan . |
| 48-47345 | 7/1973 | Japan . |
| 48-47346 | 7/1973 | Japan . |
| 58-217944 | 12/1983 | Japan . |
| 59-126546 | 7/1984 | Japan . |
| 60-93455 | 5/1985 | Japan . |
| 61-182054 | 8/1986 | Japan . |
| 64-6964 | 1/1989 | Japan . |
| 64-73354 | 3/1989 | Japan . |
| 1-237561 | 9/1989 | Japan . |
| 2-171761 | 7/1990 | Japan . |
| 3-267947 | 11/1991 | Japan . |

*Primary Examiner*—M. Nuzzolillo
*Assistant Examiner*—Laura Werner
*Attorney, Agent, or Firm*—Oliff & Berridge, PLC

[57] ABSTRACT

An electrophotographic dry toner comprising toner particles having externally added thereto fine particles of an inorganic compound having been surface treated with an amphoteric surface active agent. The toner is excellent in fluidity, anti-caking properties, charging properties, and environmental stability and provides excellent images free from defects such as black spots.

23 Claims, No Drawings

ELECTROPHOTOGRAPHIC DRY TONER COMPRISING INORGANIC PARTICLES

This is a Continuation of application Ser. No. 08/498,498 filed Jul. 5, 1995, now abandoned, which in turn is a continuation of application Ser. No. 08/119,591 filed Sep. 13, 1993, now abandoned.

FIELD OF THE INVENTION

This invention relates to a toner for developing an electrostatic latent image in electrophotography, electrostatic recording, etc.

BACKGROUND OF THE INVENTION

In electrophotography, an electrostatic latent image formed on a photoreceptor is generally developed with a toner containing a pigment, etc., and the resulting toner image is transferred to a transfer sheet and fixed thereon by a pressure roller, etc. The photoreceptor is subjected to cleaning for formation of a next latent image.

Dry developers used in electrophotography, etc. are divided into one-component developers solely composed of a toner comprising a binder resin having dispersed therein a colorant and two-component developers composed of such a toner and a carrier. In order that these developers have process suitability in copying, they are required to have excellent performance properties, such as fluidity, anti-caking properties, fixability, chargeability and cleaning properties. To improve these properties, particularly fluidity and anti-caking properties, inorganic fine particles are frequently added to a toner.

However, inorganic fine particles have considerable influences on charging properties. For example, generally employed silica type fine particles have so strong negative polarity that they cause great variations of chargeability with environmental changes. That is, silica particles excessively increase chargeability of a negatively chargeable toner in a low temperature and low humidity condition while, on the other hand, they take up moisture to reduce chargeability in a high temperature and high humidity condition, often causing poor density reproduction or development of background fog.

Dispersibility of the inorganic fine particles also has great influences on toner characteristics. Particles of poor dispersibility tend to fail to produce desired effects of improving fluidity and anti-caking properties or tend to cause adhesion of toner particles to a photoreceptor due to insufficient cleaning, resulting in image defects such as black spots.

In order to overcome these problems associated with inorganic fine particles, it has been proposed to use surface-treated inorganic fine particles. For example, surface treatment of silica fine powder to make it hydrophobic has been proposed in JP-A-46-5782, JP-A-48-47345, and JP-A-48-47346 (the term "JP-A" as used herein means an "unexamined published Japanese patent application"). However, silica fine particles which are made merely hydrophobic are not always sufficient to eliminate the disadvantages associated with inorganic fine particles.

It is known that immoderate negative chargeability of toner particles may be alleviated by external addition of silica fine particles having been surface-treated with an amino-modified silicone oil (see JP-A-64-73354) or external addition of silica fine particles having been surface-treated with an aminosilane and/or an amino-modified silicone oil (see JP-A-1-237561).

Although the treatment with these amino compounds accomplishes the purpose of suppressing an excessive increase of charge quantity of negatively chargeable toners, it does not bring about a basic solution to the environmental dependence inherent to silica fine particles. That is, while the excessive negative chargeability of silica fine particles after long-term use in a low temperature and low humidity condition can slightly be inhibited, such charge neutralization mechanism after long-term use similarly functions in a high temperature and high humidity condition. The problem of environmental dependence of silica fine particles is thus remains unsolved. In addition, the silicone oil used as a treating agent undergoes agglomeration during treatment due to its high viscosity, resulting in deterioration of powder fluidity.

It is also known to improve frictional chargeability, preservation stability and fluidity of a toner by externally adding to toner particles silica fine particles coated with a polymer which is different from the shell-forming polymer of the toner particles in frictional charging properties, for example, a polymer comprising a monomer having an amino group and a double bond in the molecule thereof, e.g., dimethylaminoethyl acrylate (see JP-A-64-6964). However, this technique aims at imparting frictional charging properties to toner particles and is no more sufficient for reduction of environmental dependence than the above-mentioned amino compounds.

On the other hand, for the purpose of improving moisture resistance and stability with time of a toner or reducing impaction onto a carrier, it has been proposed to externally add silica fine particles having been surface-treated with a fluorine-containing oil (see JP-A-58-217944) or a fluorine-substituted silane coupling agent (see JP-A-60-93455). Although these fluorine type treating agents were successful in improving moisture resistance or stain resistance of a carrier, the toner undergoes serious reduction in charging properties with time. Further, since fluorine itself has high negative chargeability, environmental dependence cannot be improved sufficiency. That is, these treating agents lift not only the low level of charge in a high temperature and high humidity condition but also the charge level in a low temperature and low humidity condition.

SUMMARY OF THE INVENTION

An object of the present invention is to provide an electrophotographic toner the environmental dependence of which is reduced without reducing frictional chargeability while minimizing an increase in frictional chargeability.

Another object of the present invention is to provide an electrophotographic dry toner which is excellent in fluidity, anti-caking properties, and charging properties.

A further object of the present invention is to provide an electrophotographic dry toner which provides images of high quality with reduced defects such as black spots.

The above objects of the present invention are accomplished by using, as an external additive, fine particles of an inorganic compound having been surface treated with an amphoteric surface active agent.

The present invention relates to an electrophotographic dry toner comprising toner particles having externally added thereto fine particles of an inorganic compound having been surface treated with at least an amphoteric surface active agent.

DETAILED DESCRIPTION OF THE INVENTION

The inorganic compounds which can be externally added to toner particles in the form of fine powder include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, and $MgSO_4$. Preferred of them is silica ($SiO_2$). Silica fine particles impart particularly excellent fluidity and anti-caking properties to toner particles.

The surface-treated inorganic compound fine particles which can be added to toner particles have an average primary particle diameter of not more than 40 nm, preferably not more than 20 nm, and more preferably not more than 16 nm. The lower limit of the primary particle diameter is 1 nm, preferably 2 nm, and more preferably 5 nm.

It is desirable for obtaining sufficient effects on environmental dependence of a toner that the inorganic compound fine particles are previously rendered hydrophobic before being surface treated.

Examples of suitable agents which can be used for rendering inorganic compound fine particles hydrophobic include alkylchlorosilanes, e.g., methyltrichlorosilane, octyltrichlorosilane, and dimethyldichlorosilane; alkylalkoxysilanes, e.g., dimethyldimethoxysilane and octyltrimethoxysilane; hexamethyldisilazane; and silicone oil.

In the present invention, the inorganic fine particles are surface treated with an amphoteric surface active agent. The terminology "amphoteric surface active agent" as used herein means a surface active agent having both a cationic active group and an anionic active group per molecule thereof so that intramolecular ionization takes place but the whole molecule has no charge. Amphoteric surface active agents which can be used in the present invention include an N-alkylnitrilotriacetic acid, an N-alkyldimethylbetaine, an α-trimethylammonio fatty acid, an N-alkyl-β-aminopropionic acid salt, an N-alkyl-β-iminopropionic acid salt, an N-alkyloxymethyl-N,N-diethylbetaine, an N-alkyl-N,N-diaminoethylglycine hydrochloride, a 2-alkylimidazoline derivative, an aminoethylimidazoline organic acid salt, an N-alkylsulfobetaine, and an N-alkyltaurine salt. In particular, those containing a fluorine atom produce remarkable effects.

Examples of suitable amphoteric surface active agents are shown below for illustrative purposes only but not for limitation.

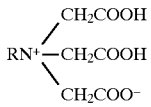
(1)

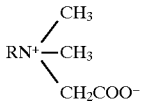
(2)

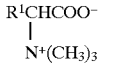
(3)

$RNHCH_2CH_2COONa$ (4)

$RN(CH_2CH_2COONa)_2$ (5)

$ROCH_2N^+(C_2H_5)_2CH_2COO^-$ (6)

$R^2NH(C_2H_4NH)_2CH_2COOH.HCl$ (7)

-continued

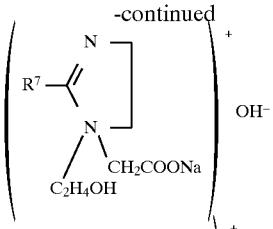
(8)

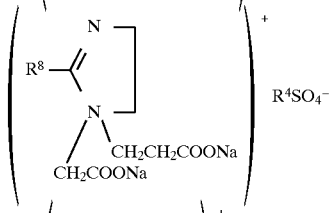
(9)

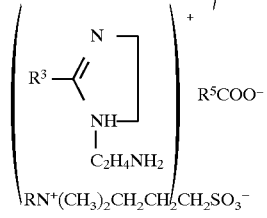
(10)

$RN^+(CH_3)_2CH_2CH_2CH_2SO_3^-$ (11)

$RN^+(CH_3)_2CH_2CH(OH)CH_2SO_3^-$ (12)

$R^2NHC_2H_4SO_3Na$ (13)

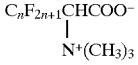
(14)

wherein

R: alkyl group having 8 to 18 carbon atoms;

$R^1$: alkyl group having 7 to 17 carbon atoms;

$R^2$: alkyl group having 12 to 18 carbon atoms;

$R^3$: alkyl group having 9 to 17 carbon atoms;

$R^4$: alkyl group having 1 to 2 carbon atoms;

$R^5$: alkyl group having 9 to 17 carbon atoms;

$R^7$: alky group having 13 to 15 carbon atoms;

$R^8$: alkyl group having 9 to 16 carbon atoms;

n: positive integer

Specific compounds included under the above formulae (1) through (14) are shown below.

(1)-1

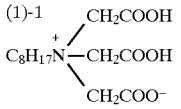

(1)-2

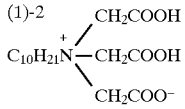

(1)-3

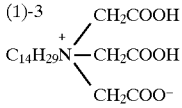

(2)-1

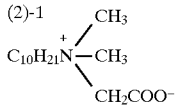

(2)-2

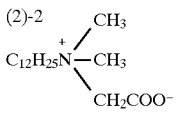

(2)-3

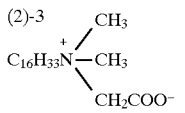

(3)-1

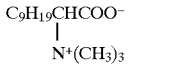

(3)-2

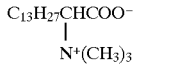

-continued (3)-3

$C_{15}H_{31}CH(N^+(CH_3)_8)COO^-$ (4)-3

$C_{18}H_{37}NHCH_2CH_2COONa$ (5)-2

$C_{13}H_{27}N(CH_2CH_2COONa)_2$ (5)-3

$C_{15}H_{31}N(CH_2CH_2COONa)_2$ (6)-1

$C_{12}H_{25}OCH_2N^+(C_2H_5)_2CH_2COO^-$ (6)-2

$C_{15}H_{31}OCH_2N^+(C_2H_5)_2CH_2COO^-$ (6)-3

$C_{18}H_{37}OCH_2N^+(C_2H_5)_2CH_2COO^-$ (7)-1

$C_{12}H_{25}NH(C_2H_4NH)_2CH_2COOH.HCl$ (7)-2

$C_{16}H_{38}NH(C_2H_4NH)_2CH_2COOH.HCl$ (8)-1

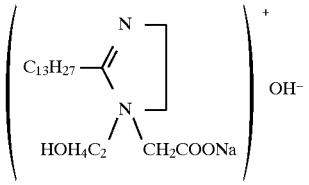

(8)-2

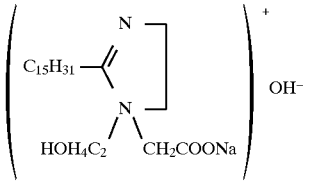

(9)-1

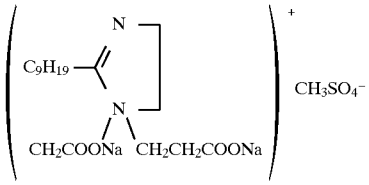

(9)-2

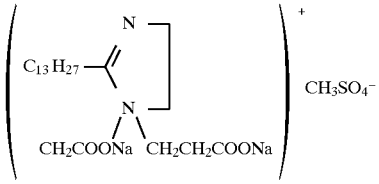

(4)-1

$C_8H_{17}NHCH_2CH_2COONa$ (4)-2

$C_{14}H_{29}NHCH_2CH_2COONa$ (5)-1

$C_{10}H_{21}N(CH_2CH_2COONa)_2$

-continued (9)-3

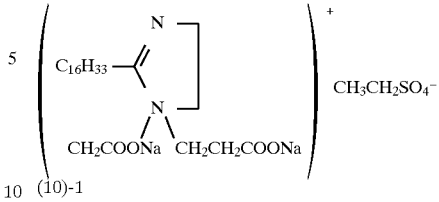

(10)-1

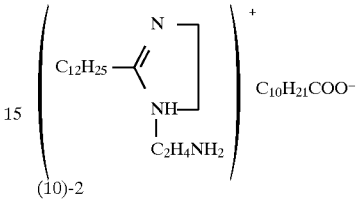

(10)-2

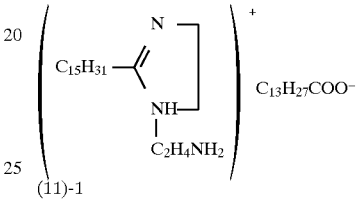

(11)-1

$C_8H_{17}N^+(CH_3)_2CH_2CH_2CH_2SO_3^-$ (11)-2

$C_{10}H_{21}N^+(CH_3)_2CH_2CH_2CH_2SO_3^-$ (12)-1

$C_{12}H_{25}N^+(CH_3)_2CH_2CH(OH)CH_2SO_3^-$ (12)-2

$C_{15}H_{31}N^+(CH_3)_2CH_2CH(OH)CH_2SO_3^-$ (13)-1

$C_{12}H_{25}NHC_2H_4SO_8Na$ (13)-2

$C_{16}H_{33}NHC_2H_4SO_3Na$ (14)-1

$C_8F_{17}CH(N^+(CH_3)_8)COO^-$ (14)-2

$C_{10}H_{21}CH(N^+(CH_3)_3)COO^-$ (14)-3

$C_{12}F_{25}CH(N^+(CH_3)_3)COO^-$

Treatment of inorganic compound fine particles with the above-described amphoteric surface active agent is generally carried out by a process comprising dissolving or dispersing the amphoteric surface active agent in an appropriate solvent, such as an alcohol, adding the solution or dispersion to inorganic compound fine particles to coat the surface thereof, and drying the treated particles to remove the solvent. The treatment is preferably effected by use of a kneader coater, a spray drier, a thermal processor, a fluidized bed apparatus, etc. If desired, the dried particles may be ground and classified.

The amount of the amphoteric surface active agent to be used generally ranges from 0.01 to 100% by weight, preferably from 0.1 to 50% by weight, more preferably from 0.5 to 30% by weight, based on the inorganic compound fine particles to be treated, though depending on the kind of the inorganic compound. It should be noted that the surface treatment of the inorganic compound fine particles with the amphoteric surface active agent aims at an improvement on environmental dependence of the inorganic compound and a toner and that the amount of the amphoteric surface active agent to be used should be selected appropriately according to the kind of the inorganic compound because application of too high an amount of the amphoteric surface active agent involves a fear of reducing the charge quantity.

Known toner particles mainly comprising a binder resin and a colorant can be used in the present invention.

Binder resins to be used in the toner particles include homo- or copolymers of styrene or derivatives thereof, e.g., chlorostyrene; monoolefins, e.g., ethylene, propylene, butylene, and isoprene; vinyl esters, e.g., vinyl acetate, vinyl propionate, vinyl benzoate, and vinyl butyrate; α-methylene aliphatic monocarboxylic acid esters, e.g., methyl acrylate, ethyl acrylate, butyl acrylate, dodecyl acrylate, octyl acrylate, phenyl acrylate, methyl methacrylate, ethyl methacrylate, butyl methacrylate, and dodecyl methacrylate; vinyl ethers, e.g., vinyl methyl ether, vinyl ethyl ether, and vinyl butyl ether; and vinyl ketones, e.g., vinyl methyl ketone, vinyl hexyl ketone, and vinyl isopropenyl ketone. Particularly useful binder resins are polystyrene, a styrene-alkyl acrylate copolymer, a styrene-alkyl methacrylate copolymer, a styrene-acrylonitrile copolymer, a styrene-butadiene copolymer, a styrene-maleic anhydride copolymer, polyethylene, and polypropylene. In addition, polyester resins, polyurethane resins, epoxy resins, silicone resins, polyamide resins, modified rosin, and paraffin waxes can also be used.

Colorants which can be used in the toner typically include carbon black, Aniline Blue, Charchoyl Blue, chrome yellow, ultramarine blue, Du Pont Oil Red, Quinoline Yellow, Methylene Blue chloride, Phthalocyanine Blue, Malachite Green oxalate, lamp black, Rose Bengale, C.I. Pigment Red 48:1, C.I. Pigment Red 122, C.I. Pigment Red 57:1, C.I. Pigment Yellow 97, C.I. Pigment Yellow 12, C.I. Pigment Blue 15:1, and C.I. Pigment Blue 15:3.

If desired, the toner particles may further contain known additives such as charge control agents, e.g., azo type metal complexes, salicylic acid metal complexes, nigrosine, and quaternary ammonium salts, and offset inhibitors, e.g., low-molecular polypropylene, low-molecular polyethylene, and waxes.

The toner particles may be a magnetic toner containing therein a magnetic substance or a capsule toner.

The toner particles usually have an average particle size of from 3 to 20 μm.

The surface-treated inorganic compound fine particles are added and blended with the toner particles by means of, for example, a twin-cylinder mixer-or a Henschel mixer. At the time of blending, various additives, such as other fluidizing agents and cleaning or transfer aids (e.g., fine particles of polystyrene, polymethyl methacrylate or polyvinylidene fluoride), may be added if desired.

The amount of the surface-treated silica fine particles to be added preferably ranges from 0.05 to 20% by weight, and more preferably from 0.1 to 5.0% by weight, based on the total toner weight.

Adhesion of the surface-treated inorganic compound fine particles to the surface of toner particles may be mere mechanical adhesion or loose fixing to the surface. Further, the surface-treated inorganic compound fine particles may be adhered to the entire surface or part of the surface of the toner particles. The surface-treated inorganic compound fine particles may be adhered partly in the form of agglomerates, but is preferably adhered in the form of a single particle layer.

The thus prepared electrophotographic dry toner of the present invention can be used either as a one-component developer as such or as a two-component developer in combination with a carrier.

Where the toner of the present invention is used as a two-component developer, the surface-treated inorganic compound fine particles may be added to a mixed system of a toner and a carrier to conduct coating of the toner particles simultaneously with the toner/carrier mixing.

The carrier to be used in the two-component developers includes iron powder, glass beads, ferrite powder, nickel powder, and these powders having thereon a resin coating.

According to the present invention, the amphoteric surface active agent exerts its charge control function without impairing powder fluidity of the inorganic compound fine particles thereby to provide a toner which retains stable charging properties for an extended period of time either in a high temperature and high humidity environment or in a low temperature and low humidity environment.

Where a polyester resin or an epoxy resin is used as a binder resin of toner particles, it has been a conventional problem that the toner shows an extreme difference in charging performance depending on the environmental conditions. This problem is effectively coped with by the external addition of the amphoteric surface active agent-treated inorganic compound fine particles.

Further, where a fluorine-containing amphoteric surface active agent is used as a treating agent, impaction onto a carrier can be alleviated owing to the small surface energy of fluorine thereby endowing a two-component developer with stability with time. In conventional techniques, use of a fluorine-containing silane coupling agent or a fluorine-containing oil as a surface treating agent brings about an improvement in moisture resistance but, on the other hand, causes a considerable reduction in charge quantity with time. Moreover, the particularly high negative chargeability possessed by fluorine has been a bar to sufficient improvement in environmental dependence. To the contrary, for some unknown reasons, use of a fluorine-containing amphoteric surface active agent as a surface treating agent makes it possible to control excessive negative chargeability of fluorine without impairing moisture resistance, resistance to staining of a carrier, and powder fluidity thereby to provide a toner with excellent environmental stability. In addition, the toner retains its charging properties in a stable manner even after taking a number of copies, involving no reduction in image quality.

EXAMPLES

The present invention will now be illustrated in greater detail with reference to Examples, but it should be understood that the present invention is not deemed to be limited thereto. All the parts, percents and ratios are by weight unless otherwise indicated.

Preparation of Additive A:

In 500 parts of ethanol was dissolved 5 parts of compound (1)-2 as an amphoteric surface active agent, and the solution was mixed with 100 parts of hydrophobic silica fine particles (RX 200 produced by Nippon Aerosil Co., Ltd.) having an average primary particle size of 12 nm by stirring. The solvent was removed by means of an evaporator, and the mixture was dried to obtain treated silica fine particles. The particles were ground in an automatic mortar and classified through a 105 μm mesh.

Preparation of Additive B:

Treated silica fine particles were prepared in the same manner as for additive A, except for using compound (7)-1 as an amphoteric surface active agent and acetone as a solvent.

Preparation of Additive C:

Treated silica fine particles were prepared in the same manner as for additive A, except for using compound (14)-3 as an amphoteric surface active agent.

Preparation of Additive D:

Treated silica fine particles were prepared in the same manner as for additive A, except for using compound (14)-1 as an amphoteric surface active agent and using isopropanol as a solvent.

Preparation of Additive E:

In 500 parts of ethanol was dissolved 10 parts of compound (14)-2 as an amphoteric surface active agent, and the solution was mixed with 100 parts of titania fine particles having an average primary particle size of 20 nm by stirring. The solvent was removed by means of an evaporator, and the mixture was dried to obtain treated titania fine particles. The particles were ground in an automatic mortar and classified through a 105 $\mu$m mesh.

Preparation of Additive F:

Treated silica fine particles were prepared in the same manner as for additive E, except for using compound (12)-1 as an amphoteric surface active agent, acetone as a solvent, and alumina having an average primary particle size of 8 nm as inorganic compound fine particles.

Preparation of Additive G:

Treated silica fine particles were prepared in the same manner as for additive A, except for using compound (14)-2 as an amphoteric surface active agent, isopropanol as a solvent, and hydrophilic silica (A 200 produced by Nippon Aerosil Co., Ltd.) having an average primary particle size of 12 nm as inorganic compound fine particles.

Preparation of Additive H:

Treated silica fine particles were prepared in the same manner as for additive A, except for a nonionic surface active agent in place of the amphoteric surface active agent.

Preparation of Additive I:

Treated silica fine particles were prepared in the same manner as for additive A, except for using a quaternary ammonium salt compound in place of the amphoteric surface active agent.

Preparation of Additive J:

Treated silica fine particles were prepared in the same manner as for additive A, except for using a 2-acrylamido-2-methylpropanesulfonic acid/styrene (15/85) copolymer in place of the amphoteric surface active agent.

Preparation of Additive K:

Treated silica fine particles were prepared in the same manner as for additive E, except for using an amino-modified silicone oil in place of the amphoteric surface active agent.

Preparation of Additive L:

Treated silica fine particles were prepared in the same manner as for additive A, except for using a fluorine-containing oil in place of the amphoteric surface active agent.

Preparation of Additive M:

Treated silica fine particles were prepared in the same manner as for additive G, except for a fluorine-substituted silane coupling agent in place of the amphoteric surface active agent.

Preparation of Additive N:

Treated silica fine particles were prepared in the same manner as for additive A, except for using compound (14)-1 as an amphoteric surface active agent.

Preparation of Additive O:

Treated silica fine particles were prepared in the same manner as for additive A, except for using compound (6)-2 as an amphoteric surface active agent.

Preparation of Additive P:

Treated silica fine particles were prepared in the same manner as for additive A, except-for using compound (4)-1 as an amphoteric surface active agent and alumina having an average primary particle size of 8 nm as inorganic compound fine particles.

Example 1

Preparation of Toner Particles:

| | |
|---|---|
| Styrene-butyl acrylate copolymer (80/20) | 100 parts |
| Carbon black (Regal 330 produced by Cabot G. L. Inc.) | 10 parts |
| Low-molecular weight polypropylene (Viscol 660P produced by Sanyo Kasei K. K.) | 5 parts |
| Azo chrome complex (Spiron Black TRH, a charge control agent produced by Hodogaya Chemical Co., Ltd.) | 1 part |

The above components were melt-kneaded in a Banbury mixer, cooled, and pulverized in a jet mill. The particles were classified by means of a classifier to obtain toner particles having an average particle diameter of 10 $\mu$m.

One part of additive A was mixed with 100 parts of the above-prepared toner particles in a Henschel mixer to prepare a toner.

Preparation of Carrier:

Ferrite particles having an average particle size of 85 $\mu$m were coated with 0.8% of a silicone resin to a coating thickness of about 1.2 $\mu$m by means of a fluidized bed coating apparatus to prepare a carrier.

Preparation of Developer:

Five parts of the toner particles and 95 parts of the carrier were blended to prepare a developer.

Example 2

A developer was prepared in the same manner as in Example 1, except for using additive B in place of additive A.

Example 3

A developer was prepared in the same manner as in Example 1, except for using additive D in place of additive A.

Example 4

A developer was prepared in the same manner as in Example 1, except for using additive F in place of additive A.

Example 5

A developer was prepared in the same manner as in Example 1, except for using additive G in place of additive A.

Example 6

Preparation of Toner Particles:

| | |
|---|---|
| Polyester resin | 100 parts |
| Carbon black (Black Pearls 1300 produced by Cabot G. L. Inc.) | 10 parts |
| Low-molecular weight polypropylene (Viscol 660P) | 5 parts |
| Azo chrome complex (Spiron Black TRH, a charge control agent) | 2 parts |

The above components were melt-kneaded in a Banbury mixer, cooled, and pulverized in a jet mill. The particles were classified by means of a classifier to obtain toner particles having an average particle diameter of 10 μm.

One part of additive E was mixed with 100 parts of the above-prepared toner particles in a Henschel mixer to prepare a toner.

Preparation of Carrier:

Spherical ferrite particles having an average particle size of 85 μm were coated with a silicone resin to a coating thickness of about 1.0 μm by means of a kneader coater to prepare a carrier.

Preparation of Developer:

Five parts of the toner particles and 95 parts of the carrier were blended to prepare a developer.

Example 7

A developer was prepared in the same manner as in Example 6, except for using additive C in place of additive E.

Example 8

Preparation of Toner Particles:

| | |
|---|---|
| Styrene-butyl acrylate copolymer (80/20) | 100 parts |
| Magnetic powder (EPT-1000 produced by Toda Kogyo K. K.) | 100 parts |
| Low-molecular weight polypropylene (Viscol 660P) | 5 parts |
| Azo chrome complex (Spiron Black TRH, a charge control agent) | 2 parts |

The above components were blended in a Henschel mixer, kneaded in a continuous kneading machine (twin-screw type), cooled, and pulverized in a jet mill. The particles were classified by means of a classifier to obtain toner particles having an average particle diameter of 10 μm.

One part of additive N was mixed with 100 parts of the above-prepared toner particles in a Henschel mixer to prepare a toner.

Preparation of Developer:

Five parts of the toner particles and 95 parts of the carrier of Example 6 were-blended to prepare a developer.

Example 9

A developer was prepared in the same manner as in Example 8, except for using additive O in place of additive N.

Example 10

A developer was prepared in the same manner as in Example 8, except for using additive P in place of additive N.

Comparative Example 1

A developer was prepared in the same manner as in Example 1, except for using the hydrophobic silica fine particles as such in place of additive A.

Comparative Example 2

A developer was prepared in the same manner as in Example 1, except for using additive H in place of additive A.

Comparative Example 3

A developer was prepared in the same manner as in Example 1, except for using additive I in place of additive A.

Comparative Example 4

A developer was prepared in the same manner as in Example 1, except for using additive J in place of additive A.

Comparative Example 5

A developer was prepared in the same manner as in Example 6, except for using the titania fine particles as such in place of additive E.

Comparative Example 6

A developer was prepared in the same manner as in Example 6, except for using additive K in place of additive E.

Comparative Example 7

A developer was prepared in the same manner as in Example 6, except for using additive L in place of additive E.

Comparative Example 8

A developer was prepared in the same manner as in Example 6, except for using additive M in place of additive E.

Comparative Example 9

A developer was prepared in the same manner as in Example 8, except for using additive I in place of additive N.

Comparative Example 10

A developer was prepared in the same manner as in Example 8, except for using the alumina fine particles as such in place of additive N.

The particulars of the additives used in the preparation of toners in the foregoing Examples and Comparative Examples are shown in Tables 1 and 2 below.

TABLE 1

| Example No. | Additive | Inorganic Compound | Surface Treating Agent |
|---|---|---|---|
| 1 | A | hydrophobic silica | amphoteric surfactant |
| 2 | B | hydrophobic silica | amphoteric surfactant |
| 3 | D | hydrophobic silica | fluorine type amphoteric surfactant |
| 4 | F | untreated alumina | amphoteric surfactant |
| 5 | G | hydrophilic silica | fluorine type amphoteric surfactant |
| 6 | E | untreated titania | fluorine type amphoteric surfactant |
| 7 | C | hydrophobic silica | fluorine type amphoteric surfactant |
| 8 | N | hydrophobic silica | fluorine type amphoteric surfactant |
| 9 | O | hydrophobic silica | amphoteric surfactant |
| 10 | P | untreated alumina | amphoteric surfactant |

TABLE 2

| Comparative Example No. | Additive | Inorganic Compound | Surface Treating Agent |
|---|---|---|---|
| 1 | hydrophobic silica | hydrophobic silica | none |
| 2 | H | hydrophobic silica | nonionic surfactant |
| 3 | I | hydrophobic silica | quaternary ammonium salt |
| 4 | J | hydrophobic silica | 2-acrylamido-2-methylpropane-sulfonic acid/styrene copolymer |
| 5 | untreated titania | untreated titania | none |
| 6 | K | untreated titania | amino-modified silicone oil |
| 7 | L | hydrophobic silica | fluorine oil |
| 8 | M | hydrophilic silica | fluorine-substituted silane coupling agent |
| 9 | I | hydrophobic silica | quaternary ammonium salt |
| 10 | untreated alumina | untreated alumina | none |

Copying Test:

Continuous copying test on each of the developers prepared was performed using an electrophotographic copying machine FX-5039 manufactured by Fuji Xerox Co. Ltd. for the developers of Examples 1 to 7 and Comparative Examples 1 to 8 and ABLE 3015 manfactured by Fuji Xerox Co., Ltd. for the developers of Examples 8 to 10 and Comparative Examples 9 to 10. Evaluation was made in the following terms. The results obtained are shown in Table 3 below.

1) Charge quantity:

A charge quantity of the developer was measured in the initial stage and after obtaining 100,000 copies in either a high temperature and high humidity environment (30° C., 90% RH; hereinafter referred to as condition I) or a low temperature and low humidity environment (10° C., 15% RH; hereinafter referred to as condition II) with a blow-off meter.

2) Toner Preservability:

Toner preservability was evaluated by observing development of agglomeration of toner particles and graded as follows.

G1 . . . No agglomeration occurred even after taking 100,000 copies.

G2 . . . Slight agglomeration occurred before taking 100,000 copies but to an acceptable extent for practical use.

G3 . . . Agglomeration occurred after taking 80,000 copies.

G4 . . . Agglomeration occurred after taking 60,000 copies and before taking 80,000 copies.

G5 . . . Agglomeration occurred after taking 40,000 copies and before taking 60,000 copies.

3) Image Ouality:

100,000 copies were taken, and the image quality was graded as follows.

G1 . . . Neither fog nor black spots were observed on the 100,000th copy.

G2 . . . Fog developed under condition I.

G3 . . . A reduction in density occurred under condition II.

G4 . . . Fog developed under condition II.

G5 . . . A reduction in density occurred under condition I.

G6 . . . A reduction in density occurred under both conditions I and II.

4) Performance of Automatic Follow-up Control of Density:

G1 . . . Charging properties were stable enough to keep satisfactory density reproducibility.

G2 . . . Charging properties underwent change, but the automatic density control mechanism works to keep satisfactory density reproducibility.

G3 . . . Charging properties underwent change somewhat great but within such a level that the automatic density control mechanism works on.

G4 . . . The automatic density control mechanism failed to follow the change in charging properties on or after obtaining 60,000 copies and before obtaining 100,000 copies.

G5 . . . The automatic density control mechanism failed to follow the change in charging properties before obtaining 60,000 copies.

TABLE 3

| Example No. | Initial Charge Quantity (μC/g) | Charge Quantity After Taking 100,000 Copies Condition I (μC/g) | Charge Quantity After Taking 100,000 Copies Condition II (μC/g) | Follow-up of Automatic Density Control | Toner Preserv-ability | Image Quality | Copying Machine |
|---|---|---|---|---|---|---|---|
| Example 1 | −24.1 | −23.6 | −25.2 | G2 | G1 | G1 | FX 5039 |
| Example 2 | −25.3 | −24.7 | −26.6 | G2 | G1 | G1 | " |
| Example 3 | −27.9 | −27.2 | −28.4 | G1 | G1 | G1 | " |
| Example 4 | −14.6 | −11.8 | −12.4 | G3 | G2 | G1 | " |
| Example 5 | −21.8 | −21.0 | −22.5 | G2 | G2 | G1 | " |
| Example 6 | −16.4 | −13.8 | −14.9 | G3 | G2 | G1 | " |
| Example 7 | −28.7 | −27.9 | −29.4 | G1 | G1 | G1 | " |
| Comparative Example 1 | −27.5 | −17.4 | −23.5 | G5 | G1 | G2 | " |
| Comparative Example 2 | −22.4 | −14.9 | −19.3 | G4 | G3 | G3 | " |
| Comparative Example 3 | −20.7 | −10.7 | −15.6 | G4 | G4 | G2 | " |
| Comparative Example 4 | −18.9 | −9.1 | −13.4 | G4 | G3 | G4 | " |
| Comparative Example 5 | −9.2 | −1.3 | −5.7 | G5 | G5 | G6 | FX 5039 |
| Comparative | −11.2 | −4.6 | −8.7 | G5 | G3 | G3 | " |

TABLE 3-continued

| Example No. | Initial Charge Quantity (μC/g) | Charge Quantity After Taking 100,000 Copies Condition I (μC/g) | Charge Quantity After Taking 100,000 Copies Condition II (μC/g) | Follow-up of Automatic Density Control | Toner Preserv-ability | Image Quality | Copying Machine |
|---|---|---|---|---|---|---|---|
| Example 6 | | | | | | | |
| Comparative Example 7 | −23.0 | −16.6 | −19.2 | G4 | G3 | G3 | " |
| Comparative Example 8 | −21.3 | −12.9 | −18.8 | G4 | G4 | G2 | " |
| Example 8 | −19.3 | −18.6 | −20.9 | G1 | G1 | G1 | ABLE 3015 |
| Example 9 | −16.7 | −14.2 | −17.4 | G2 | G1 | G1 | " |
| Example 10 | −13.8 | −9.9 | −11.6 | G3 | G2 | G1 | " |
| Comparative Example 9 | −15.6 | −8.7 | −12.5 | G4 | G3 | G5 | " |
| Comparative Example 10 | −12.6 | −5.1 | −8.9 | G5 | G5 | G6 | " |

As is apparent from the results in Table 3, the toner according to the present invention is controlled from increasing the charge quantity and thereby suppresses development of image defects such as a reduction in density even when used for a long period of time in a low temperature and low humidity environment. Further, the toner of the invention exhibits improved preservability and undergoes no agglomeration in a copying machine.

As described and demonstrated above, the present invention makes it possible to improve environmental dependence of a toner without causing a reduction in frictional chargeability while minimizing an increase in frictional chargeability. Accordingly, the dry toner of the present invention is a negatively chargeable toner excellent in fluidity, anticaking properties, and charging properties which provides excellent images free from defects such as black spots.

While the invention has been described in detail and with reference to specific embodiments thereof, it will be apparent to one skilled in the art that various changes and modifications can be made therein without departing from the spirit and scope thereof.

What is claimed is:

1. An electrophotographic dry toner comprising toner particles having externally added fine particles of an inorganic compound adhered to a surface of the toner particles, the externally added fine particles having an average primary particle diameter of from 1 to 40 nm and having been surface treated with at least an amphoteric surface active agent selected from the group consisting of α-trimethylamino fatty acid, N-alkyl-β-iminopropionic acid salt, N-alkyloxymethyl-N,N-diethylbetaine, N-alkyl-N,N-diamino ethylglycine hydrochloride, 2-alkylimidazoline, aminoethylimidazoline organic acid salt, N-alkylsulfobetaine, N-alkyltaurine salt, $$R^1CH(N^+(CH_3)_3)COO^- \quad (3)$$

$$RNHCH_2CH_2COONa, \quad (4)$$

$$RN(CH_2CH_2COONa)_2, \quad (5)$$

$$ROCH_2N^+(C_2H_5)_2CH_2COO^-, \quad (6)$$

$$R^2NH(C_2H_4NH)_2CH_2COOH.HCl \quad (7)$$

-continued

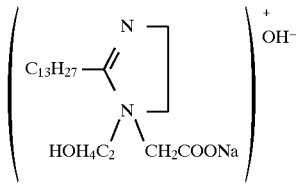

(8)-1

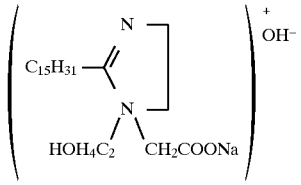

(8)-2

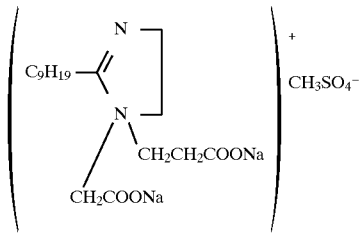

(9)-1

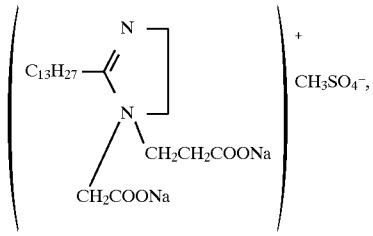

(9)-2 and

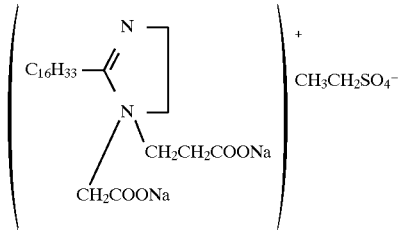

(9)-3

-continued

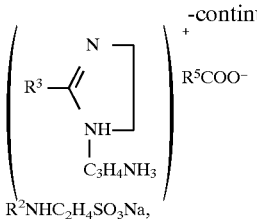

(10)

$R^2NHC_2H_4SO_3Na$, (13)

and $C_nF_{2n+1}CHCOO^-$ (14)
|
$N^+(CH_3)_3$ wherein R is an alkyl group having 8 to 18 carbon atoms;

$R^1$ is an alkyl group having 7 to 17 carbon atoms;

$R^2$ is an alkyl group having 12 to 18 carbon atoms;

$R^3$ is an alkyl group having 9 to 17 carbon atoms;

$R^4$ is an alkyl group having 1 to 2 carbon atoms;

$R^5$ is an alkyl group having 9 to 17 carbon atoms; and n is a positive integer.

2. An electrophotographic dry toner as claimed in claim 1, wherein said fine particles of an inoraganic compound are particles having been previously rendered hydrophobic.

3. An electrophotographic dry toner as claimed in claim 1, wherein said fine particles of an inoraganic compound are silica fine particles.

4. An electrophotographic dry toner as claimed in claim 1, wherein said amphoteric surface active agent is present in an amount of from 0.01 to 100 parts by weight per 100 parts by weight of the fine particles of an inorganic compound.

5. An electrophotographic dry toner as claimed in claim 1, wherein said fine particles of an inoraganic compound have been rendered hydrophobic by treating with an agent selected from the group consisting of alkylchlorosilanes, alkylalkoxysilanes, hexamethyldisilane and silicone oil.

6. An electrophotographic dry toner as claimed in claim 5, wherein said hydrophpbic agent is selected from the group consisting of methyltrichlorosilane, octyltrichlorosilane, dimethyl dichlorosilane, dimethyldidethoxysilane and octyltrimethoxy-silane.

7. An electrophotographic dry toner as claimed in claim 1, wherein said amphoteric surface active agent is selected from the group consisting of N-alkylnitrilotriacetic acid, N-alkyldimethylbetaine, α-trimethylamino fatty acid, N-alkyl-β-aminopropionic acid salt, N-alkyl-β-iminopropionic acid salt, N-alkyloxymethyl-N,N-diethylbetaine, N-alkyl-N,N-diamino ethylglycine hydrochloride, 2-alkylimidazoline, aminoethylimidazoline organic acid salt, N-alkylsulfobetaine and N-alkyltaurine salt.

8. An electrophotographic dry toner as claimed in claim 1, wherein said amphoteric surface active agent is selected from the group consisting of:

$R^1CHCOO^-$ (3)
|
$N^+(CH_3)_3$ $RNHCH_2CH_2COONa$ (4)

$RN(CH_2CH_2COONa)_2$ (5)

$ROCH_2N^+(C_2H_5)_2CH_2COO^-$ (6)

$R^2NH(C_2H_4NH)_2CH_2COOH.HCl$ (7)

-continued

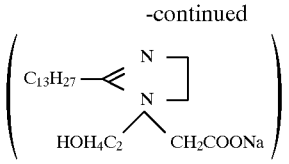

(8)-1

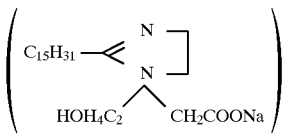

(8)-2

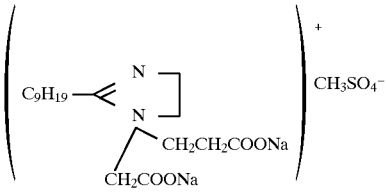

(9)-1

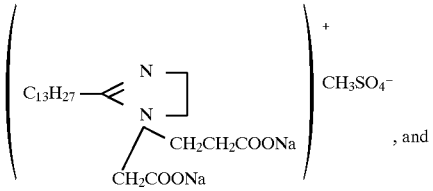

(9)-2

, and

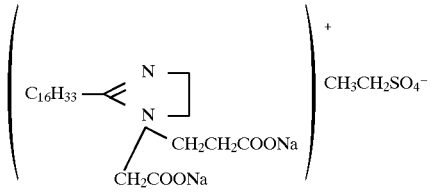

(9)-3

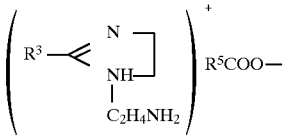

(10)

$R^2NHC_2H_4SO_3Na$, and (13)

$C_nF_{2n+1}CHCOO^-$ (14)
|
$N^+(CH_3)_3$ (14)

wherein R is an alkyl group having 8 to 18 carbon atoms;

$R^1$ is an alkyl group having 7 to 17 carbon atoms;

$R^2$ is an alkyl group having 12 to 18 carbon atoms;

$R^3$ is an alkyl group having 9 to 17 carbon atoms;

$R^4$ is an alkyl group having 1 to 2 carbon atoms;

$R^5$ is an alkyl group having 9 to 17 carbon atoms;

and n is a positive integer.

9. An clectrophotographic dry toner as claimed in claim 1, wherein said amphoteric surface active agent is $C_9H_{19}CHCOO^-$ (3)-1
|
$N^+(CH_3)_3$, $C_{13}H_{27}CHCOO^-$ (3)-2
|
$N^+(CH_3)_3$, or $C_{15}H_{31}CHCOO^-$ (3)-3
|
$N^+(CH_3)_3$.

10. An electrophotographic dry toner as claimed in claim 1, wherein said amphoteric surface active agent is (4)-1

$C_8H_{17}NHCH_2CH_2COONa$, (4)-2

$C_{14}H_{29}NHCH_2CH_2COONa$, or (4)-3

$C_{18}H_{37}NHCH_2CH_2COONa$.

11. An electrophotographic dry toner as claimed in claim 1, wherein said amphoteric surface active agent is (5)-1

$C_{10}H_{21}N(CH_2CH_2COONa)_2$, (5)-2

$C_{13}H_{27}N(CH_2CH_2COONa)_2$, or (5)-3

$C_{15}H_{31}N(CH_2CH_2COONa)_2$.

12. An electrophotographic dry toner as claimed in claim 1, wherein said amphoteric surface active agent is (6)-1

$C_{12}H_{25}OCH_2N^+(C_2H_5)_2CH_2COO^-$, (6)-2

$C_{15}H_{31}OCH_2N^+(C_2H_5)_2CH_2COO^-$, or (6)-3

$C_{18}H_{37}OCH_2N^+(C_2H_5)_2CH_2COO^-$.

13. An electrophotographic dry toner as claimed in claim 1, wherein said amphoteric surface active agent is (7)-1

$C_{12}H_{25}NH(C_2H_4NH)_2CH_2COOH.HC1$, or (7)-2

$C_{16}H_{33}NH(C_2H_4NH)_2CH_2CCOOH.HC1$.

14. An electrophotographic dry toner as claimed in claim 1, wherein said amphoteric surface active agent is

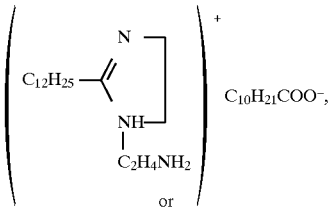

(10)-1

$C_{10}H_{21}COO^-$, or

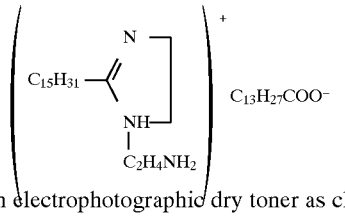

(10)-2

$C_{13}H_{27}COO^-$

15. An electrophotographic dry toner as claimed in claim 1, wherein said amphoteric surface active agent is (13)-1

$C_{12}H_{25}NHC_2H_4SO_3Na$ , or (13)-2

$C_{16}H_{33}NHC_2H_4SO_3Na$.

16. An electrophotographic dry toner as claimed in claim 1, additionally comprising a carrier.

17. An electrophotographic dry toner as claimed in claim 1, wherein the inorganic compound of the externally added fine particles is selected from the group consisting of silica, alumina and titania.

18. An electrophotographic dry toner comprising toner particles having externally added fine particles of an inorganic compound having been surface treated with at least an amphoteric surface active agent, wherein said amphoteric surface active agent is

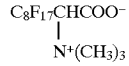

(14)-1

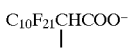

(14)-2

, or

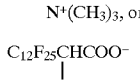

(14)-3

.

19. An electrophotographic dry toner comprising dry toner particles having externally added fine particles of an inorganic compound having been surface treated with at least one amphoteric surface active agent selected from the group consisting of

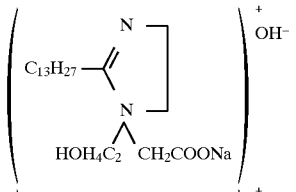

(8)-1

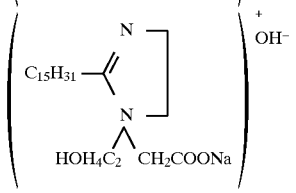

(8)-2

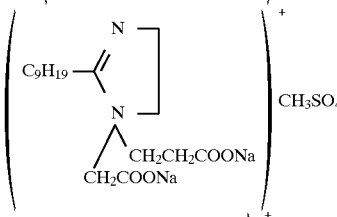

(9)-1

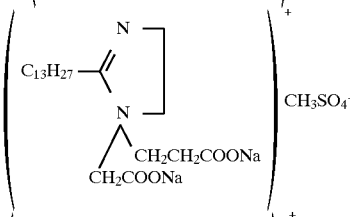

(9)-2

, and

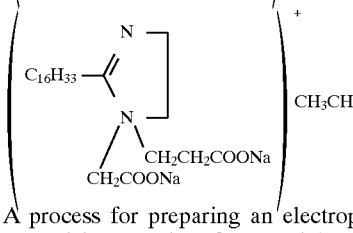

(9)-3

20. A process for preparing an electrophotographic dry toner comprising treating fine particles of an inorganic compound with an amphoteric surface active agent selected from the group consisting of

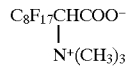

(14)-1

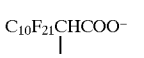

(14)-2

, and

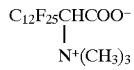

(14)-3 and adding the fine particles to toner particles.

21. A process as claimed in claim 20, comprising dissolving or dispersing the amphoteric surface active agent in a solvent, adding the solution or dispersion to the fine particles of an inoraganic compound to coat the surface thereof and drying the particles to remove the solvent.

22. A process as claimed in claim 20, wherein said treating step is effected by use of a kneader coater, a spray dryer, a thermo processor or a fluidized bed apparatus.

23. A process according to claim 20, wherein the amount of amphoteric surface active agent is from 0.01 to 100% by weight based on the weight of the fine particles of an inoraganic compound.

* * * * *